US010514172B2

(12) United States Patent
Acker

(10) Patent No.: US 10,514,172 B2
(45) Date of Patent: Dec. 24, 2019

(54) FLUID DISTRIBUTION SYSTEM

(71) Applicant: Advanced Conservation Technologies Distribution, Inc., Costa Mesa, CA (US)

(72) Inventor: Larry K. Acker, Costa Mesa, CA (US)

(73) Assignee: ADVANCED CONSERVATION TECHNOLOGY DISTRIBUTION, INC., Costa Mesa, CA (US)

( * ) Notice: Subject to any disclaimer, the term of this patent is extended or adjusted under 35 U.S.C. 154(b) by 0 days.

(21) Appl. No.: 15/871,307

(22) Filed: Jan. 15, 2018

(65) Prior Publication Data

US 2019/0219276 A1 Jul. 18, 2019

(51) Int. Cl.
*F24D 17/00* (2006.01)
*F24D 19/10* (2006.01)

(52) U.S. Cl.
CPC ..... *F24D 17/0078* (2013.01); *F24D 17/0031* (2013.01); *F24D 17/0073* (2013.01); *F24D 19/1051* (2013.01)

(58) Field of Classification Search
USPC ..... 137/801, 565.16
See application file for complete search history.

(56) References Cited

U.S. PATENT DOCUMENTS 4,321,943 A 3/1982 Haws
4,798,224 A 1/1989 Haws
5,042,524 A 8/1991 Lund
5,277,219 A 1/1994 Lund
6,036,333 A * 3/2000 Spiller ..... F03B 13/00 290/43
6,106,705 A * 8/2000 Giordano ..... B01D 17/0208 137/801
6,876,100 B2 * 4/2005 Yumita ..... F03B 13/00 290/43
6,895,985 B2 * 5/2005 Popper ..... E03B 7/04 137/2
6,913,203 B2 * 7/2005 DeLangis ..... G05D 23/1393 137/624.11
7,253,536 B2 * 8/2007 Fujimoto ..... E03D 3/00 290/43
7,608,936 B2 * 10/2009 Shimizu ..... E03C 1/0404 290/43

(Continued)

*Primary Examiner* — Jessica Cahill
*Assistant Examiner* — Daphne M Barry
(74) *Attorney, Agent, or Firm* — Carlos A. Fisher; Stout, Uxa & Buyan, LLP

(57) ABSTRACT

Fluid distribution systems comprising a wireless, self-recharging fluid distribution system and method for their use. In a preferred example, the fluid distribution system is an automated or semi-automated on-command hot water system, wherein the wireless, self-recharging fluid distribution system comprises a fluid turbine and a battery, for converting fluid flow into electricity to recharge the battery. In certain examples, the wireless, self-recharging fluid distribution system also comprises a sensor component, such as a sensor selected from the group consisting of a pressure sensor, a moisture sensor, a sound-receiving sensor, a temperature sensor, a flow sensor, and a chemical sensor. In some examples such fluid distribution systems may be of particular use in environments having limited access to electricity, such as vessels, mobile homes, trailers, and "of the grid"structures having no access to dependable electricity supply.

9 Claims, 5 Drawing Sheets

(56) References Cited

U.S. PATENT DOCUMENTS

| | | | | |
|---|---|---|---|---|
| 8,698,333 | B2 * | 4/2014 | Glasser | F03B 13/00 290/43 |
| 9,513,019 | B2 | 12/2016 | Acker | |
| 10,215,424 | B2 * | 2/2019 | Acker | F24D 19/1063 |
| 2007/0246941 | A1 * | 10/2007 | Tanaka | F03B 3/02 290/1 R |
| 2008/0136191 | A1 * | 6/2008 | Baarman | F03B 1/00 290/54 |
| 2008/0284175 | A1 * | 11/2008 | Nagler | F03B 13/00 290/54 |
| 2009/0008943 | A1 * | 1/2009 | Kemper | F03B 13/00 290/54 |
| 2013/0248019 | A1 * | 9/2013 | Frick | E03C 1/04 137/468 |

* cited by examiner

FLUID DISTRIBUTION SYSTEM

FIELD OF THE INVENTION

The present invention is generally directed to fluid distribution systems and preferably directed to plumbing systems of high thermal and energy efficiency.

BACKGROUND OF THE INVENTION

As described in U.S. Pat. Nos. 4,321,943 and 4,798,224, a considerable amount of thermal energy may be wastefully dissipated from hot water lines which provide hot water to plumbing fixtures, such as domestic wash basins, dishwashers and clothes washers. This thermal energy is generated from heating sources utilizing fuels such as heating oil, coal, natural (petroleum) gas, and electric heating means (which may ultimately use any one of these fuels, as well as hydraulic, wind and solar generating sources to generate the electricity).

In addition, if water is allowed to run down the drain while waiting for hot water to be delivered to the fixture from a remote hot water source, a substantial water loss may occur. As droughts have become more and more frequent, water loss can become costly, and can contribute to water shortages in various localities.

In order to reduce such water loss, plumbing systems have been devised which continuously circulate hot water from a hot water source to the fixture and back to the hot water source. In such systems, a supply of hot water is always readily and quickly available at a given plumbing fixture despite the remote position of the hot water source. As a result, the water loss is then limited to the amount of cold water disposed in draw pipes interconnecting the plumbing fixture to the hot water conduit in which hot water is circulated.

While such systems substantially reduce the amount of water which must be withdrawn from the fixture before suitable hot water is obtained, they are not energy efficient because the array of pipes interconnecting the plumbing fixtures in the hot water source provide an enormous surface area for thermal radiation therefrom. Such thermal radiation requires continual reheating of the water in the hot water lines to compensate for to heat loss. In addition, the electrical cost of running a circulating pump may cause such system to be prohibitive in view of the energy conscious requirements of many local, state and federal governmental agencies.

Thermal losses in both circulating and non-circulating plumbing systems have been reduced by the installation of insulation to the exterior of the hot water lines as well as to the heating source (e.g., hot water heaters, boilers, and the like) that feed the plumbing fixtures with hot water. While such insulation can slow the dissipation of heat, no savings occur over an extended period of time in non circulating systems because intermittent use of hot water through the lines still allows hot water to cool to ambient temperatures. In constantly circulating systems, of course, there is a continual thermal loss.

With specific reference to noncirculating systems, devices have been developed to actually recover the hot water remaining in the hot water lines after the use of a fixture by drawing the hot water back into the hot water tank; e.g., see U.S. Pat. Nos. 4,321,943 and 4,798,224. Because hot water is removed from the lines in such systems, there is an actual reduction in the amount of heat loss rather than just a slowing of heat loss as occurs through the use of insulation alone.

U.S. Pat. No. 5,042,524, is directed to an accelerated hot water delivery system which substantially reduces thermal losses by providing intermittent, rather than constant, circulation of heated water through the hot water lines. The hot water circulation may be initiated by any suitable means, such as, a timer, a motion sensor or wall switch located close to the plumbing fixture.

In some systems in which the hot water is either constantly or intermittently recirculated, particularly those installed in newly constructed buildings, a dedicated hot water recirculating line may be installed. This dedicated recirculation line begins and terminates at the hot water source, and feeds hot water via a recirculation pump to each plumbing fixture through a series of feeder lines. This permits hot water to quickly flow from the hot water line to a given fixture when the tap, shower or appliance is used.

In some other systems, such as the system described in U.S. Pat. No. 5,277,219, the cold water line may be used as a return line for a hot water loop by connecting the hot water line to the cold water line and utilizing a pump that is able to generate a sufficient head to overcome the water pressure in the cold water line; such utilization of the cold water line to recirculate hot water shall be termed "cross-connection" herein. Additionally, particularly when the pump is not a positive displacement type pump, a one way valve is very preferably disposed between the hot water and cold water lines to prevent heated water from being circulated through the pump to the cold water lines after the heated water is delivered to the fixture in question. Typically, the valve is, e.g., a solenoid type valve hardwired to the controller. This enables an instant hot water system to be readily retrofitted into existing homes without the need for the installation of a separate dedicated return line to the hot water heater.

In the past number of years "on command" instant hot water systems have undergone a change in sophistication as computers and mobile computing devices such as, without limitation, computers, smart phones, tablet computing devices, key fobs and the like have become a tool from which multiple appliances and devices, in the home and in the office, can be controlled. U.S. Pat. No. 9,513,019 is drawn to an on-command hot water system in which a remote computer, including a mobile computing device, may be used to control the operation of, and to receive information from and concerning, the instant hot water system, either through direct "wired" connections such as Etherenet, or by wireless connections.

Wireless technology has been proposed for hot water recirculation. Thus, Bell & Gossett makes a wireless recirculation kit called the ecocirc wireless Potable Hot Water Recirculation Kit, which includes a recirculation pump and an under-sink cross connection system in which hot and cold water lines are connected. A battery-operated wireless valve opens to permit recirculation of hot water until a pre-set temperature threshold is reached at a temperature sensor within the valve. The valve then sends instructions to the pump to stop recirculating hot water. See Instruction Manual, available at http://bellgossett.com/pumps-circulators/circulator-pumps/potable-water-circulators/ecocirc-wireless-instant-hot-water-system/, accessed Oct. 30, 2017.

Each and every patent, patent publication and item of non-patent literature cited in this specification is hereby individually incorporated by reference in its entirety.

SUMMARY OF THE INVENTION

The present invention comprises a wireless self recharging valve component preferably comprising one or more sensors. In preferred embodiments at least one of said sensors comprises a temperature sensor. In a preferred embodiment of the present invention a temperature sensor of the wireless self recharging valve component may be configured for detecting a selected water temperature and in conjunction with one or more controller component, wirelessly causing the control system to stop the pump. Alternatively, the temperature sensor of the valve component may be adapted for interacting with the controller component to detect a temperature increase, or gradient, and in conjunction therewith wirelessly causing the control system to stop the pump.

Additionally, in various embodiments the wireless, self recharging valve assemblies according to the present invention may be used as components of fluid distribution systems (including hot and/or cold water distribution systems, gas and petroleum fluid distribution systems and crop irrigation systems) in any location in which reliable electrical systems are lacking, or where the availability of electricity is limited. Such locations may include: developing countries in which electricity is not universally available; commercial or recreational vessels, mobile homes and trailers, "off grid" structures, and the like. Furthermore, in other embodiments, the wireless, self recharging valve component of the invention may be used for water distribution in a multizonal structure or complex, or for other purposes, such as crop irrigation, liquid petroleum distribution, gas distribution, and the like.

In a particularly preferred embodiment the wireless water valve component of the present invention is structured to be self-rechargeable. Thus, the valve assembly contains a generator component turbine that rotates when water flows through a water line to which the valve component is connected. As used herein, the term "line", when used in this context, shall mean a fluid conduit, such as a pipe. The rotating turbine cause electricity to be generated through the windings of an generator component. This current is then directed to one or more rechargeable battery within the wireless, self recharging assembly.

Thus, in some embodiments the invention is directed to an on command hot water delivery system (HWDS) which includes a hot water source, and hot water delivery lines connected between the hot water source and at least one plumbing fixture. A cold water delivery line is provided and connected between the plumbing fixture and a cold water source and the hot water source for delivering cold water thereto. Additionally, a junction is created connecting the hot and cold water lines of, preferably, the last plumbing fixture along the hot water line from the hot water source. An electrically-actuated wireless valve component, structured as described above, is situated to prevent or allow an open connection between the cold water line and the hot water line, depending upon whether the valve is closed or open, respectively.

A temperature sensor is preferably contained within the valve assembly. A wireless transmitter in the valve assembly communicates with a HWDS controller which turns the pump off when hot water is delivered to the fixture. The HWDS may be configured to turn the pump off when a preset temperature is reached at the valve apparatus or may be configured to turn on and off according to a preset, preferably programmable, timed schedule.

Alternatively, and preferably, the hot water system may preferably comprise a temperature sensor (or HWDS controller) which is configured to detecting or calculate a temperature increase, or gradient ($\Delta T$) and in response thereto, causing the pump to stop. Thus, no matter what the actual temperature of the water in the line is, an large enough increase in $\Delta T$ will cause the pump to stop.

A HWS system having a hot water circulating pump in accordance with the present invention may include a controller component, locally and/or remotely located, for detecting, measuring, or sensing an event, for example, activation or deactivation of the pump; or for turning the pump on or off. In one exemplary HWDS, the temperature sensor in the valve component, in conjunction with a controller component, senses a change in water temperature over a temperature gradient time period, such as about 1 second or more, or about 2 seconds or more, 5 seconds or more, or about 10 seconds or more, or about 30 seconds or more, or about 45 seconds or more, or about 1 minute or more, or about 2 minutes or more, or about 3 minutes or more, or about 4 minutes or more, or about 5 minutes or more. The controller component may be programmed to turn off the circulating pump if a $\Delta T$ increase in temperature over this temperature gradient time period exceeds a certain number of degrees (the $\Delta T$ threshold), for example 1° F. or more, 2° F. or more, 3° F. or more, 4° F. or more, 5° F. or more, 10° F. or more, or 20° F. or more. In certain examples, this $\Delta T$ threshold may be adjustable by a user, locally and/or remotely. The recirculating pump recirculates water through the hot and cold water delivery lines. The HWDS causes the pump to circulate water from the hot water line into the cold water line and back to the hot water source when the valve assembly on the fixture is opened, e.g., by actuating a solenoid valve. The temperature sensor, connected to the HWDS controller, causes the pump to stop when the water at the fixture is sufficiently hot, and simultaneously closes the valve component in order to prevent heated water from being circulated to the cold water delivery lines.

In this manner, the cold water delivery lines are used as a return loop for water to the hot water source, which eliminates the need for installation of a separate return line as is common in circulating water systems. In one embodiment of the present invention, manual switches may be provided and connected to the HWDS controller to provide a means for causing the control means to turn on the pump. In the same or another embodiment the HWDS the valve assembly may comprise a sensor capable of detecting when a demand for hot water is made. Such a sensor may comprise, without limitation: a flow detector that detects water flow when a faucet, shower, or appliance tap has been opened, a temperature detector, a sound detector or a pressure detector. Such a sensor or detector may preferably be contained within the valve assembly and wirelessly connected to the HWDS controller for automatically causing the control system to turn on the pump when demand for hot water is made or anticipated.

In other embodiments the present invention may comprise a "trunk and branch"-type fluid line system (which may comprise an "on command" hot water system or a simple hot and/or cold water distribution system) comprising a wireless, self-recharging valve component within one or more of the branch lines. In such a water distribution system the plumbing system may, for example, be designed so that the water conduit is not laid out in a single loop; rather the plumbing is designed to serve discrete zones of a single structure, or of more than one structure, each of which may have its own unique water demand patterns. In such a system, water distribution from the trunk line to one or more branch line may be automated so that it can be controlled remotely, either manually at a remote location, or by a controller located at a remote location.

In such a system it may be desirable to provide fluid distribution to some "branch" lines, while withholding fluid delivery to other lines. For example, in a simple trunk and branch water distribution system, such as in crop irrigation systems, a plurality of "branch" water lines may deliver irrigation to different crops which may have different watering requirements. In such case system a wireless, self-recharging valve eliminates the need to manually open and close branch water lines to different crops, as well as the need to run electricity along the trunk line to energize the valves located at or near the junction of the trunk and branch lines.

In such a trunk and branch system the wireless, self-recharging valve component of the present invention comprises a wireless receiver at which the valve component receives instructions from the controller component to close or open the solenoid valve. In preferred embodiments the wireless, self recharging valve component comprises a wireless receiver, a wireless transmitter, and and at least one sensor component. For example, in an irrigation application as described above, the valve assembly may comprise a moisture sensor which permits the valve component to sense rainfall or other moisture within a particular crop zone, and send this information to the controller in order to modify the irrigation schedule for one or more of such zones. For example, water may be withheld from such zone or zones during a time when water would normally be supplied by closing one or more automated valve, such as a wireless, self-recharging valve component.

In trunk and branch systems that are a part of an on-command hot water distribution system in one embodiment the plumbing is designed to serve discrete zones of a single structure (such as multistory building, such as an apartment building, factory, or condominium complex) or more than one structure (such as a multi-building apartment complex or condominium complex, a factory complex and the like), each of which may have its own unique hot water demand patterns. In this embodiment a wireless, self-recharging valve assembly comprising a temperature detector may be placed near the junction of one or more each the branch line and the trunk line, so as to enable the wireless transmission of temperature-related data to the controller and to open or close the valve in response to commands wirelessly received from the controller. In this way both energy and water may be conserved when not all the zones are being used at once.

In additional embodiments the wireless, self-recharging valve assembly comprising a temperature detector may be used in conjunction with any fluid line creating a flow that provides the energy to turn the turbine of the electrical generator contained in the wireless, self-recharging valve assembly. Thus, the wireless, self-recharging valve assembly my be used with any system involving the flow of any fluid, including for example, petroleum, air, gas (including natural gas) and the like.

The following detailed description of some preferred embodiments of the invention are meant to further illustrate the invention, rather than to limit it. The invention shall be defined exclusively by the claims.

DETAILED DESCRIPTION OF THE INVENTION

Figure 1A:
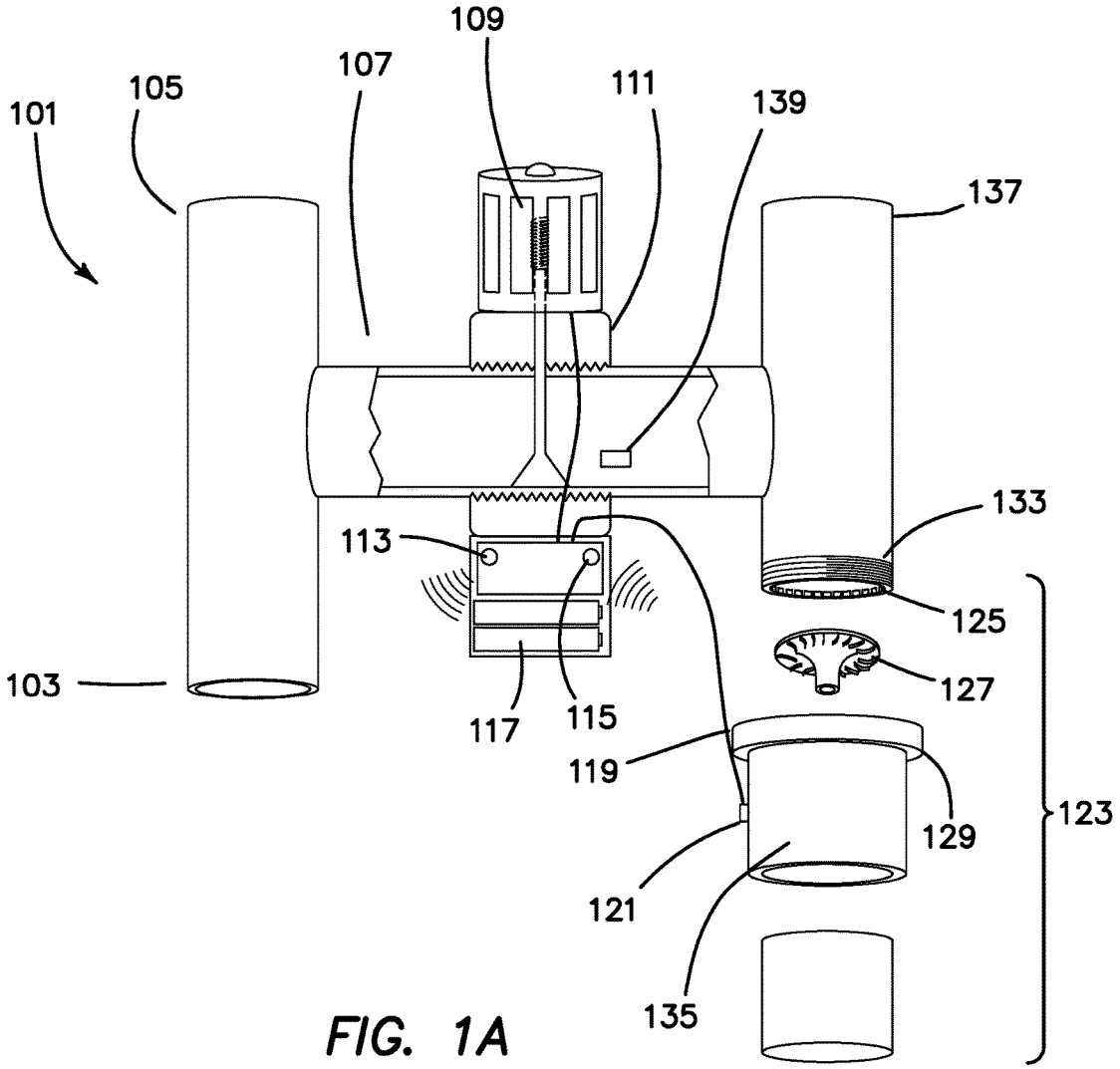
FIG. 1A depicts a side view of one embodiment of a wireless, self-generating valve component of the present invention.

In the embodiment of the invention shown in FIG. 1A, a plumbing fixture cross-connection assembly 101 for an on command HWDS is shown. The assembly is shown in FIG. 1A as it would be configured in this embodiment; those of ordinary skill in the art recognize that there are various alternative ways in which this assembly may be configured, all of which are within the scope of the invention.

As shown, hot water inlet 103 is connected to the hot water line (not shown) and hot water outlet 105 is connected to the plumbing fixture inlet (not shown). The plumbing fixture may, without limitation, be a faucet, shower, bathtub, or an appliance, such as a washing machine. The hot and cold water cross connection pipe 107 is provided with the solenoid valve 109, which remains in the closed position, preventing mixing of hot water and cold water, except during hot water recirculation. Sensor 139 is also contained within the wireless, self-recharging valve assembly housing; in this embodiment the sensor obtains temperature or $\Delta T$ information from the water contained in, or during recirculation) passing through the cross-connection pipe 107.

In addition to the solenoid valve 109, the wireless, self-recharging valve assembly comprises a housing 111 containing the solenoid valve, a wireless transmitter 113, wireless receiver 115, and at least one rechargeable storage battery 117, which is charged through wire 119 by generator component 123. The components of the generator are shown in partially exploded form. The generator component 123 provides a direct (DC) electrical current in response to the rotation of the rotor 207 relative to the stator 125 in generator component 123. The rotor and stator are retained in place within the wireless, self-recharging valve assembly by collar 129, which is threaded on the inside, and engages with the threads of cold water pipe inlet 133. Those of ordinary skill in the art will immediately be able to envision other means for retaining the rotor and stator within the valve assembly, and other water turbine and turbine blade designs; it is necessary that the rotor can turn in response to fluid flow and that fluid flow can pass through and continue along downpipe of the turbine. Wire 119 leads from the generator to the solenoid valve assembly.

As depicted, under normal operation (i.e., when recirculation of hot water is not activated), hot water enters the wireless, self-recharging valve assembly via inlet 103, and is directed to the plumbing fixture, exiting the valve assembly via outlet 105. Similarly, under normal operation cold water enters the valve assembly 101 through inlet 135 of case component 121 and exits to the plumbing fixture through outlet 137. As it transits valve assembly 101 the cold water flow causes rotor 127 to rotate against the stationary stator 125 causing a current flow through the coils of the generator assembly 123. The current flow exits the generator through wire 119 to charge the rechargeable battery(ies) 117 of solenoid valve 109.

Those of ordinary skill in the art will recognize that the placement of the rotor and generator within the fluid conduits of the wireless, self-recharging fluid distribution system may be chosen in alternative configurations e.g., within a cold water line, within a cross-connection line, or within a hot water line. Generally the rotor and generator is placed within the conduit having the greatest about to flow, thereby providing the greater ability to recharge the batteries.

Battery(ies) 117 not only power the solenoid valve 109, but also transmitter 113 and receiver 115. In some embodiments a small microcircuit (not shown) within the valve assembly housing receives signals via the wireless receiver 115 from the HWDS controller to open or close solenoid valve 109. The data collected by sensor 139 is sent to the microcircuit, which then transmits the data to the HWDS controller via wireless transmitter 113. The HWDS controller then send a signal to start or stop the pump, and/or direct the wireless, self-recharging valve assembly to open or close the valve, based upon these temperature data.

Figure 1B:
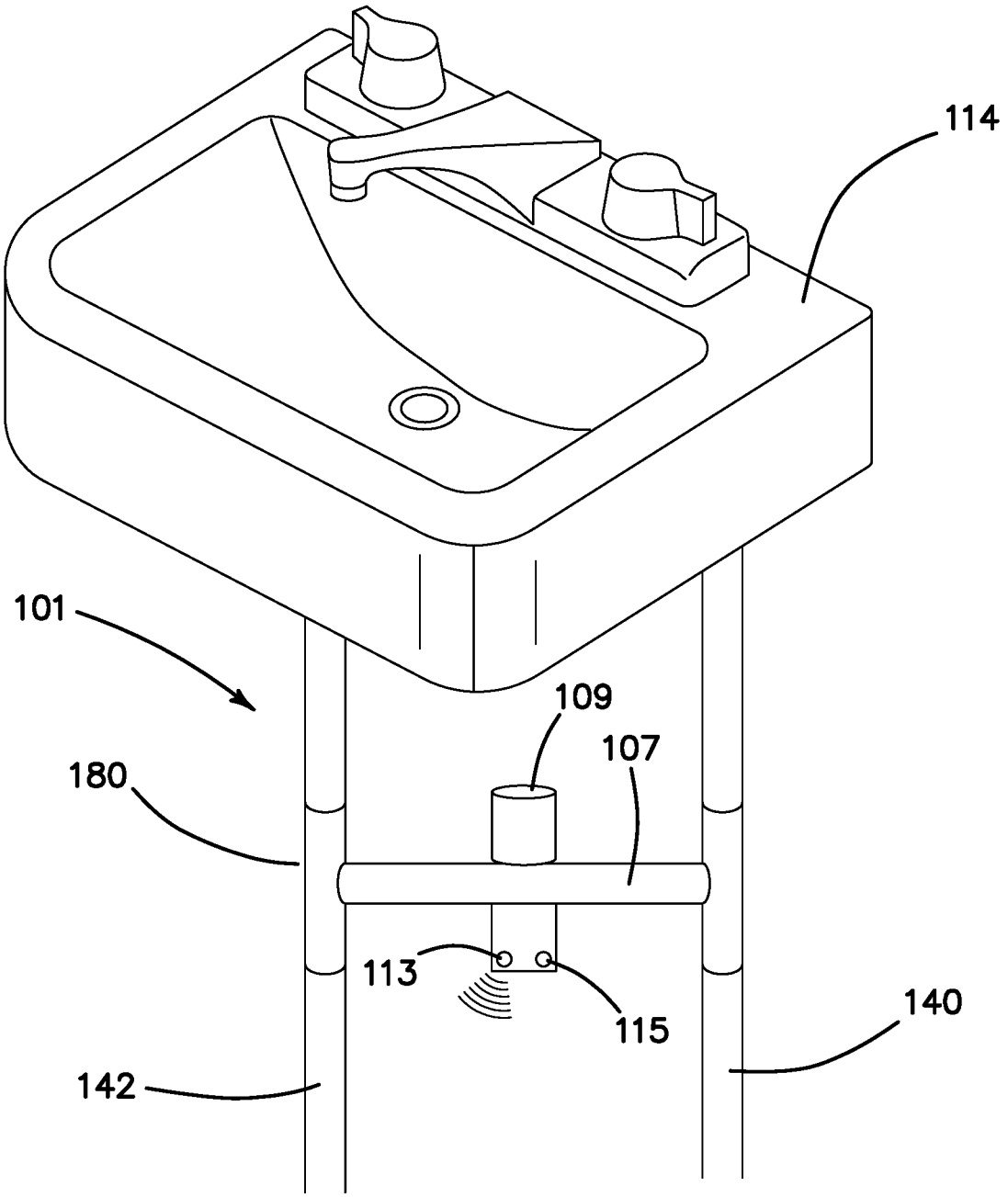
FIG. 1B shows a an example of a manner of installation of the wireless, self-generating valve component shown in FIG. 1A.

FIG. 1B shows the wireless, self recharging valve component 180 of FIG. 1A as installed under a sink and connecting hot water line 142 and cold water line 140.

Figure 2:
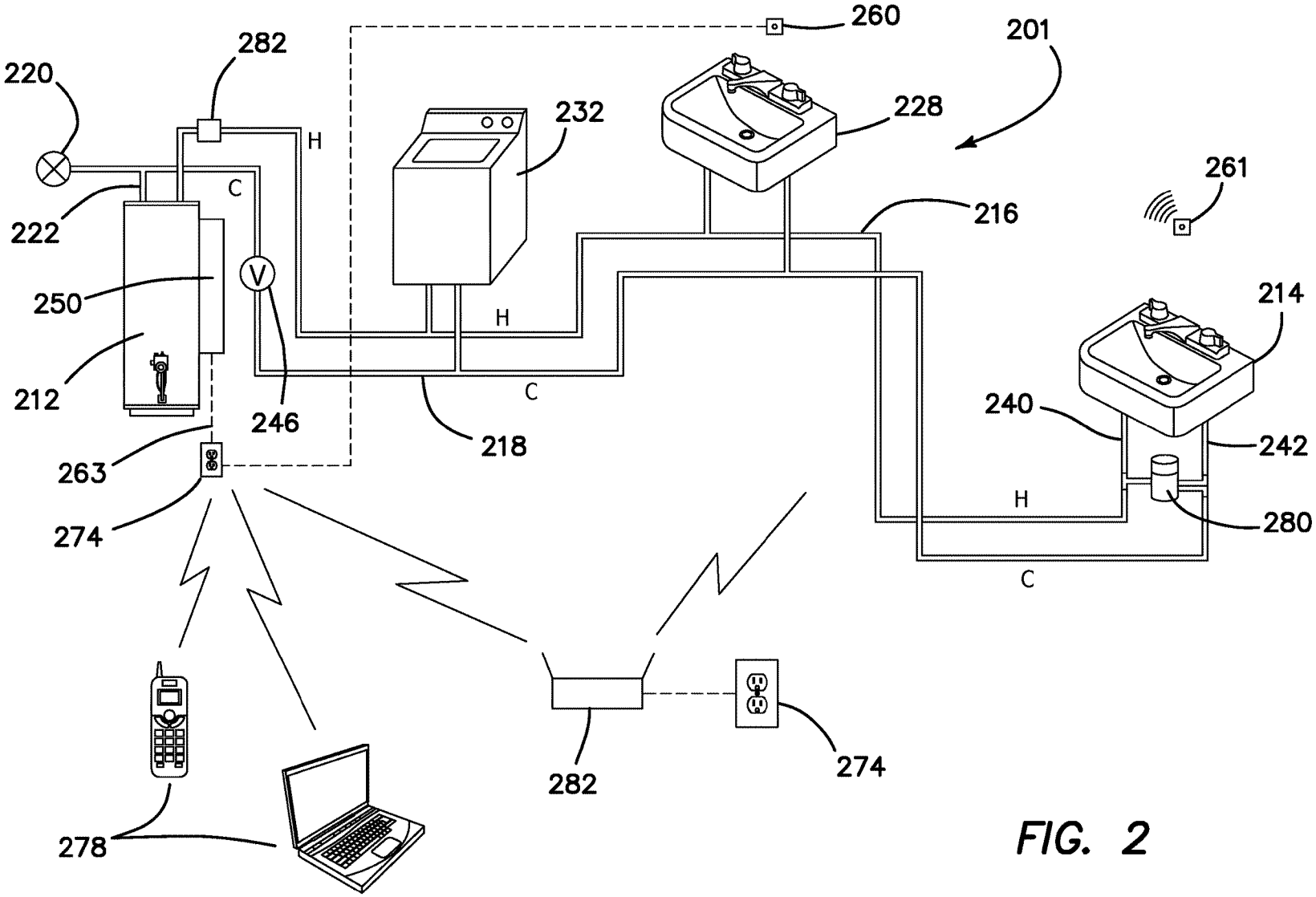
FIG. 2 shows a schematic diagram of an exemplary hot water distribution system according to the present invention employing a wireless, self-generating valve component such as that shown in FIG. 1A.

With reference to FIG. 2, there is shown, as an another example of the present invention, a hot water distribution system 201 which generally includes a hot water source 212 such as a gas or electric hot water heater, connected to a plumbing fixture such as one or more sink 214, 228 an appliance such as a washing machine 232, a shower (not shown) or any other suitable fixture by a hot water deliver line 216 and cold water delivery line 218. It is to be appreciated that the hot water source 212 may be a water heater 212 as shown, an apparatus as described in U.S. Pat. No. 4,798,224, entitled "Automatic Hot Water Recovery System," or as shown in U.S. Pat. No. 5,042,524, entitled "Demand Recovery System", a geothermal source, a solar source, a photovoltaic source, or any other source of hot water. The cold water delivery line 218 interconnects the sink 214, 228 with a cold water source 220 which is also interconnected with the hot water source 212 via a feed line 222.

Optional plumbing fixtures may be provided along with other plumbing fixtures utilized in residences and businesses, all such fixtures being connected in a configuration with the hot water delivery line 216 and cold water delivery line 218. At a selected plumbing fixture, preferably the most remote fixture from the hot water source 212 along the hot water line 216, such as sink 214, a wireless, self-charging valve 280 is interconnected between the hot water delivery line 216 and the cold water delivery line 218 via the feed lines 240, 242 respectively; this type of connection may be termed a "cross connection".

Pump 246 provides means for circulating water from the hot water delivery line 216 through the cold water delivery line 218 and back into the hot water source 212 via line 222, by utilizing the cold water delivery line as a return feeder to the hot water source 212. The pump 246 is shown in FIG. 2 to be located downstream from, and near to, the hot water source 212 (essentially "pulling" hot water from the hot water source); in other embodiments the pump 246 may be located near the selected plumbing fixture 214, or may be located on the cold water side of the hot water source 212 ("pushing" cold water into to hot water source).

In order for the pump 246 to effect flow in a reverse manner through the cold water delivery line 218 and into the hot water tank 212, the pump 246 must, of course, develop sufficient pressure to overcome static water pressure in the line 218.

The hot water delivery system 210 of the present invention can be used in conjunction with an existing plumbing system, which may include the hot water source 212, hot and cold water delivery lines 216, 218, and at least one plumbing fixture 214. The advantages of this type of HWDS is significant in that no unwanted disruption or renovation of the home or business is needed in order to implement the hot water recovery system in accordance with the present invention.

A controller system 250 may be mounted in any convenient location whereby it may send and receive wireless instructions to and from the wireless, self-recharging valve component. The controller 250 is shown here located on the hot water source 212. Persons skilled in the art will recognize that the controller 250 and pump may independently be located in any other location suitable for controlling the recirculation of hot water in the HWDS, such as close to fixture 114. As shown the controller 250 is wired 262 to also receive signals to turn on the pump 246 from sensors (such as motion sensors or flow sensors) or switches 260. As shown, these sensors or switches may be directly connected or, as seen with the sensor/switch 261 near sink 214, may be wireless.

The controller component 250 may be directly connected 263 to an electrical outlet 274, or may be battery operated, and contains a wireless transmitter and wireless receiver to send and/or receive signals from and to the pump 246, wireless sensors/switches 261, and/or wireless, self-recharging valve component 280. Thus, in other examples signals, particularly wireless signals may be relayed with, for example, a compiler, router or modem 282 which serves to relay sensor and control data to and/or from the controller component and/or a remotely located controller component (such as comprised in a mobile telephone, laptop computer, key fobs or other computing device 278) to and from one or more HWDS components, including the wireless, self-recharging valve component.

It is envisioned that the wireless, self-recharging valve component may be used in combination with a system similar to that disclosed in U.S. Pat. No. 9,513,913, incorporated by reference herein. In certain examples of such a system a user is able to receive alerts, status and statistical data, and other information relating to the HWDS in locations remote to the HWDS, such as by using wireless mobile telephone, key fobs, computer, or tablet devices. It is also envisioned that the user will be able to send commands from such a device to the HWDS, for example, to turn on or off the HWDS system (which may include the pump and/or the hot water source), or to override or modify the automated operation of the HWDS, such as setting or adjusting temperature thresholds, setting or adjusting $\Delta T$ thresholds, setting or adjusting hot water source water temperature, setting or adjusting pump speed, setting or adjusting timer settings, setting or adjusting duration of pump operation, setting or adjusting period of pump inactivity, and the like. These control signals may travel back along the previously described network to the specific HWDS (e.g., controller component 250) components affected by the control instructions.

A sensor or control switch 260, 261 may comprise, consist essentially of, or consist of at least one sensor selected from the group consisting of: a manual switch, a motion detector, a proximity detector, a temperature detector, a flow detector, a sound producing element or a sound detector.

In certain embodiments, the wireless, self-recharging valve assembly of the present invention may itself contain a temperature sensor and one or more additional sensor, selected from the group consisting of a manual switch, a motion detector, a proximity detector, a temperature detector, a flow detector, or a sound detector. Very preferably said one or more additional sensor is located within the hot water line portion of the self-recharging valve assembly so as to detect activation of hot water flow, thus signaling that the recirculation pump should turn on, and that the solenoid valve should open.

Figure 3:
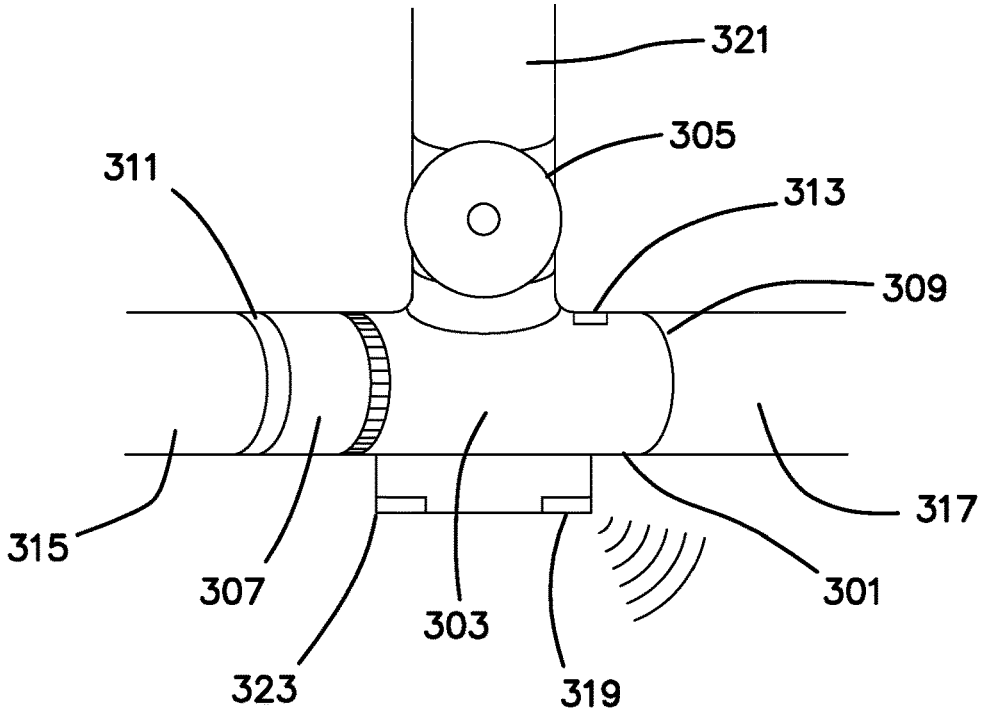
FIG. 3 shows another embodiment of a wireless, self-generating valve component according to the present invention.

Turning to FIG. 3 another type of wireless, self recharging valve assembly is shown in plan view. In this assembly, designed for a trunk and branch-type water distribution system, the valve assembly 301 comprises a "T", rather than an "H" shape as in the HWDS shown in FIG. 2. In this design, which may be used for water distribution in a multizonal structure or complex, or for other purposes, such as crop irrigation, liquid petroleum distribution, gas distribution, and the like.

Trunk pipe segments 315 and 317 are segments of the main line carrying the fluid to multiple branch lines (such as branch line 321) to the trunk line, with fluid flow from left to right.

The wireless, self recharging valve assembly 301 is connected to trunk line segments 315 and 317 and to the end of branch line 321. The valve assembly 301 comprises solenoid valve 305, which is placed in the branch line entry position of the valve assembly. Those of ordinary skill in the art are aware that the branch lines normally have a smaller cross-sectional area than the trunk line, and may be in either the closed position or the open position at rest, depending upon the user's desire.

The valve assembly also contains the generator 311 and turbine assembly 307 in the trunk line portion of the valve assembly, so that electricity may be generated when the solenoid valve is closed or open; this arrangement thus permits electricity to be generated to recharge the battery within housing 303 regardless whether solenoid valve 305 is open or closed. Also contained within the valve assembly housing is a wireless transmitter 319, a wireless receiver (not shown), sensor 313, and a microcontroller to receive and differentiate control and sensor signals, open and close the solenoid valve 305, and relay sensor signals to a remote controller via wireless transmitter 319.

Sensor 313 may be any suitable sensor, and, for irrigation purposes, may be a moisture sensor that samples the soil in which the wireless valve assembly is placed. For example, a moisture sensor may sense that the soil is moist and the controller can be programmed to close the solenoid valve in response. Conversely, the moisture sensor may sense that the soil is dry, and the controller can be programmed to open the solenoid valve in response thereto In alternative embodiments, the sensor may, without limitation, comprise a pressure sensor, a sound-receiving sensor, a temperature sensor, a flow sensor, or may be a sensor sampling the chemical composition of the fluid flowing through the trunk line. In some embodiments, the valve component may be structured to operate as part of a gas distribution system, such as a natural gas system.

When used in e.g., petroleum applications the liquid or gaseous fluid may be sampled and a chemical sensor of the wireless, self-recharging valve of the present invention may be used in a trunk and branch-type system to sort petroleum of different types, or degrees of purity or refinement, into different storage tanks or reactors.

Figure 4:
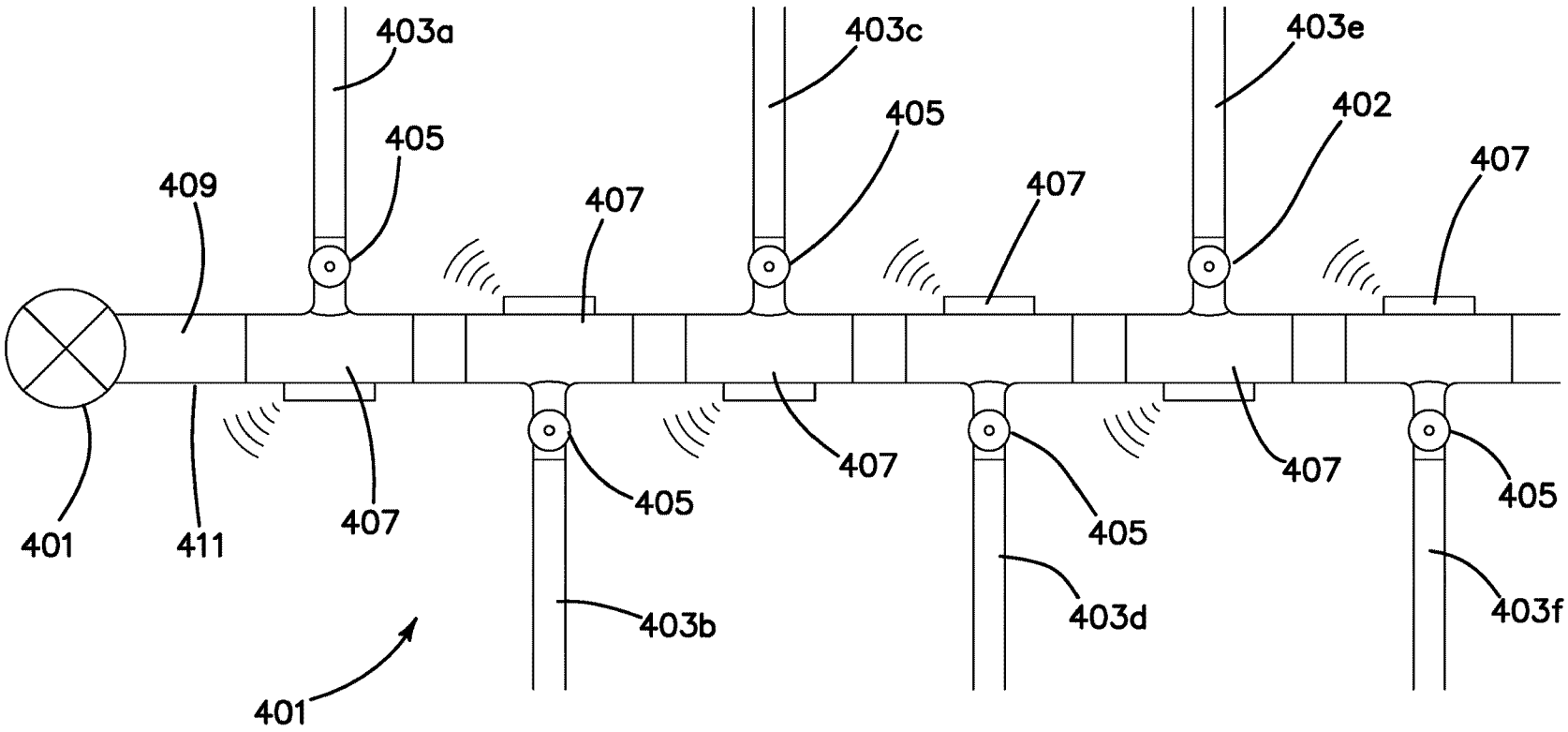
FIG. 4 shows a generic trunk and branch fluid distribution system utilizing a plurality of wireless, self-generating valve components.

In FIG. 4 a trunk and branch-type fluid distribution system 401 is shown in which the fluid distribution system is designed to serve discrete zones. The generic distribution system shown in FIG. 4 may be used for water distribution in a single structure, or more than one structure, water distribution to discrete irrigation zones, petroleum fluid distribution to discrete petroleum processing tanks or areas, or the like. In each case, some or each zone may have its own unique fluid demand requirements.

As depicted in FIG. 4, a fluid is conveyed from a source 401 via trunk conduit 411 to six zones served by feeder ("branch") loops 403 A-F simultaneously. Feeder loops 403 A-F in fluid communication with conduit 411 extend vertically along, and preferably on either side of, the conduit. Fluid flow may be initiated using a controller upstream by operation of a pump (not shown).

Wireless, self-recharging valve assemblies 407 are installed as "T" junctions are the intersection of the branch 405 and trunk 411 lines. As shown in FIG. 3, each valve assembly 407 comprises an automated valve (such as a solenoid valve); a water turbine which rotates a rotor component of a generator relative to a stator resulting in the flow of an electrical current to one or more rechargeable battery of the wireless, self-recharging valve assembly; one or more sensor component, which may, without limitation, comprise a pressure sensor, a moisture sensor, a sound-receiving sensor, a temperature sensor, a flow sensor, or a chemical sensor; a wireless receiver receiving signals and instructions from a remote controller.

A controller (which may be located proximate to the pump) may be located at a location remote from the self-recharging valve assemblies located at a plurality of branch lines. If necessary or desirable one or more repeater components can be used to intercept, amplify, and relay wireless signals between the controller (which is preferably programmable) and the self-recharging valve assemblies.

Figure 5:
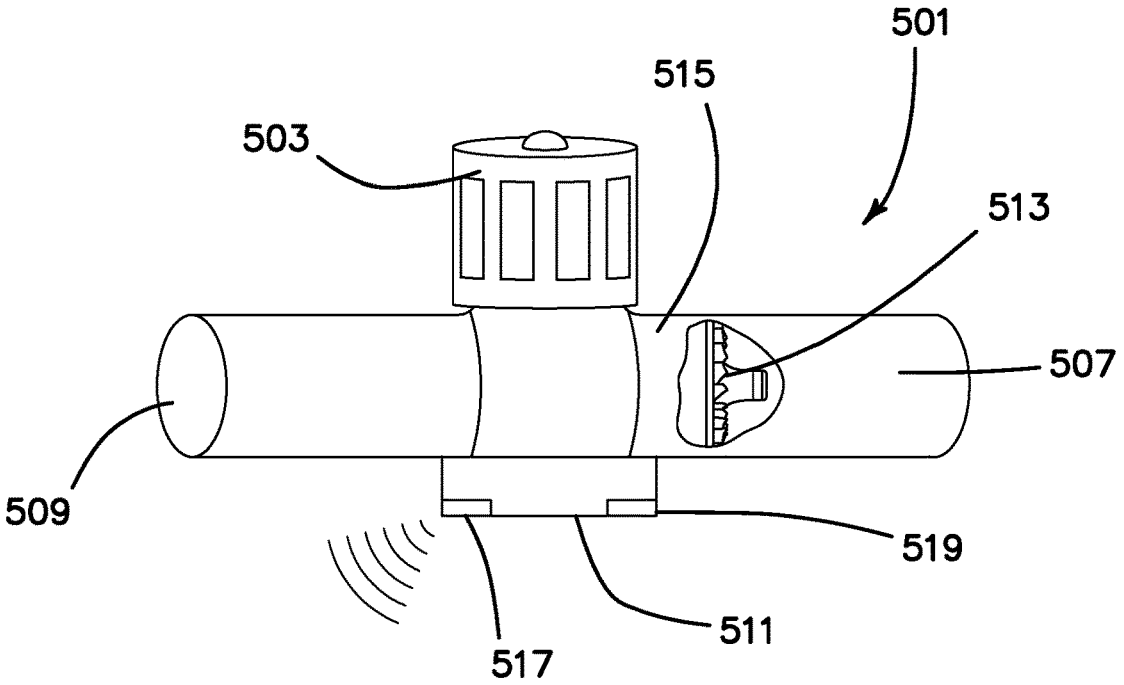
FIG. 5 shows a further embodiment of the wireless, self-generating valve component of the present invention.

In FIG. 5, the wireless, self-generating valve component within a pipe segment is shown 501. Again the exterior portion of the solenoid valve component 503 is shown; the valve is preferably configured to be closed when the solenoid is not energized so that back pressure cannot open the valve. The pipe segment has an inlet 507 and an outlet 509. Affixed to the wireless, self-generating valve component is a battery case 511, which holds one or more rechargeable batteries. The batteries are electrically connected with conducting wires to the solenoid coils (not shown) within the housing so as to create a magnetic field causing the valve to open when energized thereby. Additionally, the batteries energize the wireless transmitter 517 and receiver 519, which may be comprised in the same or different locations of the wireless, self-generating valve component. The wireless, self-generating valve component is also configured to turn the pump on or off upon receipt of a signal from a remote controller, and to send temperature, flow, and/or other data to the controller.

Within the valve is a rotor 513 and generating apparatus comprising a stator 515; the generator apparatus is electrically connected to the batteries so as to provide an electrical current when water flow from inlet to within the pipe. The rotor 513, as shown, is unidirectional. Those of ordinary skill in the art are aware that bi-directional rotors (such as helical rotors) may instead be used in any embodiment of the present invention so as to generate an electrical current when flow occurs in either direction.

Those or ordinary skill in the art will recognize that the arrangement of the fluid distribution system shown in FIG. 4 is only one example of such a distribution system. Other possible arrangements include the use of a wireless multi-valve fluid manifold comprising a large pipe segment containing a plurality of automated valves (e.g. solenoid valves) leading to the smaller pipe segments into which smaller pipes lead. In some embodiments the wireless multi-valve fluid manifold may comprise a "single piece" manifold cast or otherwise formed out of metal or a polymer, and comprising additional valves, generator components, electrical connections between the valves, rechargeable batteries and a wireless transmitter/receiver component for obtaining control signals from, and sending sensor signals (such as pressure data from a pressure sensor) to, a remote controller component.

In such a manifold, a turbine and generator component generates electricity with fluid flow within a large pipe segment component of the manifold, thus causing the battery to recharge when any of the valves is open. In some embodiments this manifold comprises one or more pressure sensor; for example, pressure sensors may be placed within each of the main pipe or channel and/or the smaller channels of the wireless, multi-valve, self recharging manifold for monitoring the pressure and each of the trunk line and the branch lines. In other embodiments of this aspect of the invention a sensor component may not be necessary.

To the extent that a plurality of inventions are disclosed herein, any such invention shall be understood to have disclosed herein alone, in combination with other features or inventions disclosed herein, or lacking any feature or features not explicitly disclosed as essential for that invention. For example, the inventions described in this specification can be practiced within elements of, or in combination with, other any features, elements, methods or structures described herein. Furthermore, each of said plurality of inventions is not to be construed as implicitly requiring elements or any other invention disclosed herein.

Additionally, features illustrated herein as being present in a particular example are intended, in other examples of the present invention, to be explicitly lacking from the invention, or to be combinable with features described elsewhere in this patent application, in a manner not otherwise illustrated in this patent application or present in that particular example. The scope of the invention shall be determined solely by the language of the claims.

Thus, the various descriptions of the invention provided herein illustrate presently preferred examples of the invention; however, it will be understood that the invention is not limited to the examples provided, or to the specific configurations, shapes, and relation of elements unless the claims specifically indicate otherwise. Based upon the present disclosure a person of ordinary skill in the art will immediately conceive of other alternatives to the specific examples given, such that the present disclosure will be understood to provide a full written description of each of such alternatives as if each had been specifically described.

What is claimed is:

1. An on command hot water delivery system (HWDS) comprising a recirculation pump which is turned on and off by a controller component, and a wireless, self-recharging fluid distribution system component comprising a) a hot water line segment having a hot water inlet and a hot water outlet, b) a cold water line segment having a cold water inlet and a cold water outlet, and c) a junction line segment fluidly connecting said hot water line segment and said cold water line segment, said junction line segment comprising i) a temperature sensor component, and ii) an automated valve component actuated wirelessly to open and close a connection between the cold water line segment and the hot water line segment, said wireless, self-recharging fluid distribution system component further comprises d) a generator component turbine disposed within said hot water line segment or said cold water line segment and being structured to rotate when water flows therethrough;

e) a rechargeable battery component electrically connected to and charged by said generator component turbine and electrically connected to and powering said automated valve component;

said wireless, self-recharging fluid distribution system component comprising a wireless receiver/transmitter enabled to wirelessly transmit temperature-related data to said controller component, and to open or close the automated valve component in response to commands wirelessly received from the controller component, said wireless, self-recharging fluid distribution system component consisting of a single automated valve component.

2. The on command hot water delivery system (HWDS) of claim 1 in which the cold water outlet and the hot water outlet of the wireless, self-recharging fluid distribution system component are connected to one or more faucets, and wherein the controller component opens the automated valve of the wireless, self-recharging fluid distribution system component when the recirculation pump is on, thereby causing hot water to flow into the junction line segment and backwards through the cold water inlet of the cold water line segment when said one or more faucets are closed.

3. The on command hot water delivery system (HWDS) of claim 1 further comprising a sensor component selected from the group consisting of a pressure sensor, a sound-receiving sensor, a flow sensor, and a chemical sensor.

4. A wireless, self-recharging fluid distribution system component comprising a) a fluid line segment having a fluid inlet and a fluid outlet, b) an automated valve component disposed within said fluid line segment and structured to be actuated wirelessly to open and close a fluid connection between the fluid inlet and the fluid outlet, and c) a sensor component;

d) a generator component turbine being structured to rotate when water flows therethrough;

e) a rechargeable battery component electrically connected to and charged by said generator component turbine and electrically connected to and powering said automated valve component;

said wireless, self-recharging fluid distribution system component comprising a wireless receiver/transmitter enabled to wirelessly transmit sensor data to a controller component, and to open or close the automated valve component in response to commands wirelessly received from the controller component; said wireless, self-recharging fluid distribution system component consisting of a single automated valve component.

5. A fluid distribution system comprising the wireless, self-recharging fluid distribution system component of claim 4.

6. The wireless, self-recharging fluid distribution system of claim 5 wherein said generator component turbine is located in a water line directing water to a plumbing fixture, said sensor component is a temperature sensor, and said sensor component and said automated valve are located in a pipe linking a hot water and a cold water line to a plumbing fixture.

7. The wireless, self-recharging fluid distribution system of claim 5 wherein said generator component turbine is located in a water line directing water to a first zone, and said automated valve is located in a line directing water to a second zone.

8. The wireless, self-recharging fluid distribution system of claim 5 comprising a plant irrigation system.

9. The wireless, self-recharging fluid distribution system of claim 5 in which a sensor component is selected from the group consisting of a pressure sensor, a moisture sensor, a sound-receiving sensor, a temperature sensor, a flow sensor, and a chemical sensor.

* * * * *